United States Patent [19]

Austin

[11] 3,941,515

[45] Mar. 2, 1976

[54] CENTRIFUGAL FLUID PUMP

[76] Inventor: Joseph R. Austin, 2513 20th Road North, Apt. 201, Arlington, Va. 22201

[22] Filed: Apr. 16, 1975

[21] Appl. No.: 568,625

[52] U.S. Cl. ..... 417/240; 415/122 R

[51] Int. Cl.[2] ..... F04D 29/26

[58] Field of Search ..... 417/240, 241, 242, 211, 417/329; 415/122

[56] References Cited

UNITED STATES PATENTS 3,465,684 9/1969 Moll ..... 417/211

*Primary Examiner*—Henry F. Raduazo

*Attorney, Agent, or Firm*—Mills and Coats

[57] ABSTRACT

A centrifugal fluid pump comprising a driven rotary assembly having at least two pumping stages operatively associated therewith and rotatable therewith as said rotary assembly is driven, each stage including a plurality of circumferentially spaced hydraulic cylinders operatively interconnected between a fluid supply tank that furnishes the respective hydraulic cylinders with the fluid and a pressure tank adapted to receive fluid under pressure from the respective hydraulic cylinders as the rotary assembly is driven. In operation, fluid is drawn into the hydraulic cylinders, and as the rotary assembly is driven the respective pistons of the hydraulic cylinders are driven radially outward causing fluid disposed on the outer sides thereof to be forced outwardly from the hydraulic cylinders under the influence of the centrifugal force generated by the rotary assembly. The pressure of the output fluid system is compounded by connecting the individual cylinders in series wherein the output of one cylinder is the input of an adjacently series connected cylinder. During this process, fluid is pumped from a supply tank through respective hydraulic cylinders of the pumping system, into a fluid pressure tank, the pressure of the fluid in the pressure tank being substantially greater than the pressure of the fluid in the supply tank as a result of the centrifugal force applied against the fluid as the rotary assembly is driven. It follows that the energy associated with the pressurized fluid can be harnessed by any suitable means, such as by pumping the pressurized fluid through a conventional hydraulic motor or using the pressurized fluid to drive some other fluid operated power generating mechanism.

14 Claims, 8 Drawing Figures

CENTRIFUGAL FLUID PUMP

The present invention relates to power generating systems, and more particularly to a centrifugal fluid pump adapted to generate by centrifugal force a system of pressure fluid flow.

Energy is presently the focal point of many private and public discussions. The scarcity and cost of energy has prompted people to seriously consider methods of energy conservation and more efficient power generating devices and systems.

The present invention relates to a more efficient power generating system. More particularly, a series of hydraulic cylinders are mounted about a driven rotary assembly, and as the rotary assembly is driven the hydraulic cylinders are carried thereby. The hydraulic cylinders are arranged in stages and the cylinders of each stage are connected in series, and respective cylinders of each stage are connected to other respective cylinders of another stage in such a manner that fluid can be pumped not only between cylinders of a stage but can be pumped from one stage to another stage.

In operation, fluid is supplied to the individual hydraulic cylinders, and as the hydraulic cylinders are driven in a circular path by the rotary assembly, the centrifugal force present causes the pistons in the individual hydraulic cylinders to exert a force against the fluid within the cylinders and to expel the fluid from respective cylinders under pressure. The hydraulic cylinders are in effect connected in series and a pumping action is achieved and fluid is pumped from one cylinder to another as the rotary assembly is driven. Because of the centrifugal force of the piston against the fluid within any hydraulic cylinder, it is appreciated that this force increases the pressure of the fluid while pumping the fluid through the system. Because of the series connections, it is seen that the pressure of the fluid as it is pumped through the series network of hydraulic cylinders is compounded and it is this compounded pressure of the final flow of fluid from the system that gives rise to a great energy source, and the very high pressure fluid flow being pumped from the network of hydraulic cylinders can be used to drive a hydraulic pump or some other fluid operated power source.

It is, therefore, an object of the present invention to provide a very efficient fluid power generating system.

Another object of the present invention is to provide an efficient fluid power generating system that converts simple mechanical energy into a form of fluid energy, the fluid energy being in a system of fluid flow wherein the pressure of the fluid flow is substantially increased by the power generating system during the energy conversion.

Another object of the present invention is to provide a centrifugal pump or power generating system that is capable of converting simple mechanical energy into a readily usable form of fluid energy.

A further object of the present invention is to provide a rotary pumping mechanism wherein a series of fluid pumping hydraulic cylinders are rotatively driven in a circular path by a rotary assembly, and wherein said hydraulic cylinders are normally disposed in radial alignment with respect to said rotary assembly such that respective pistons within said hydraulic cylinders are urged outwardly by the influence of centrifugal force as said rotary assembly is driven, whereby fluid disposed outwardly of the respective pistons is expelled under pressure from the hydraulic cylinders.

Still a further object of the present invention is to provide a rotary pumping mechanism of the type referred to above wherein there is provided means for rotating the respective hydraulic cylinders with respect to the rotary assembly in order that the hydraulic cylinders may be recharged when the respective pistons reach the outer radial extremity of the power stroke during the pumping process.

Another object of the present invention is to provide a power generating system or rotary pumping mechanism wherein the hydraulic cylinders comprising the pumping system are effectively connected in series wherein the output of anyone hydraulic cylinder may be the input of another hydraulic cylinder so as to effectively compound the pressure of the fluid as it is pumped through the network of series connected hydraulic cylinders.

A further object of the present invention is to provide a power generating system of the type having a main rotary assembly wherein the rotary assembly is adapted to generate a plurality of relative spin movements that may be used to actuate and control the various hydraulic cylinders and the pumping process during operation.

Other objects and advantages of the present invention will become apparent from a study of the following description and the accompanying drawings which are merely illustrative of the present invention.

BRIEF DESCRIPTION OF THE DRAWINGS

FIG. 8 is a schematic view illustrating a flow control mechanism for controlling the rate of fluid flow between the centrifugal pump and a hydraulic drive motor or the like.

DESCRIPTION OF PREFERRED EMBODIMENT

Figure 1:
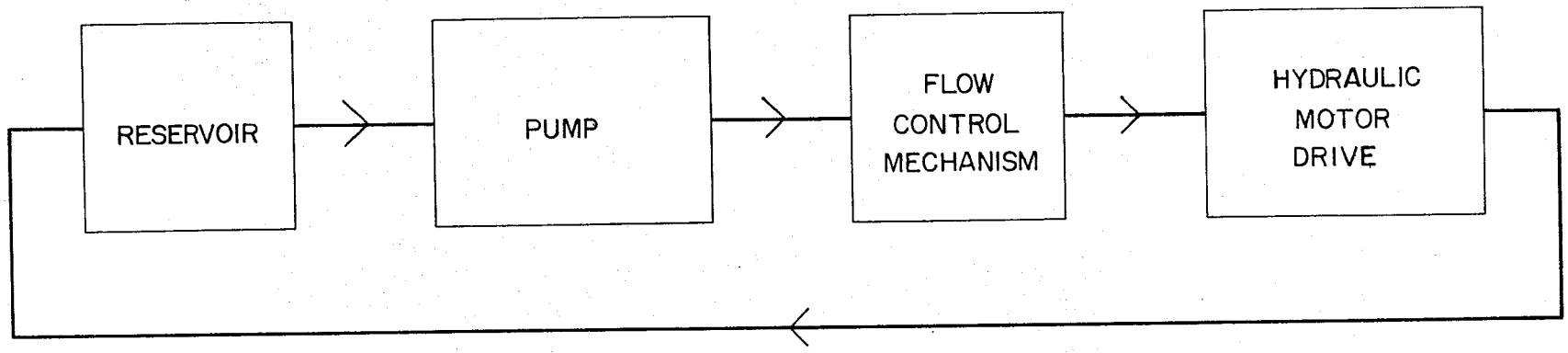
FIG. 1 is a simple flow chart showing how the centrifugal fluid pump of the present invention operates within a total system environment.
Figure 2:
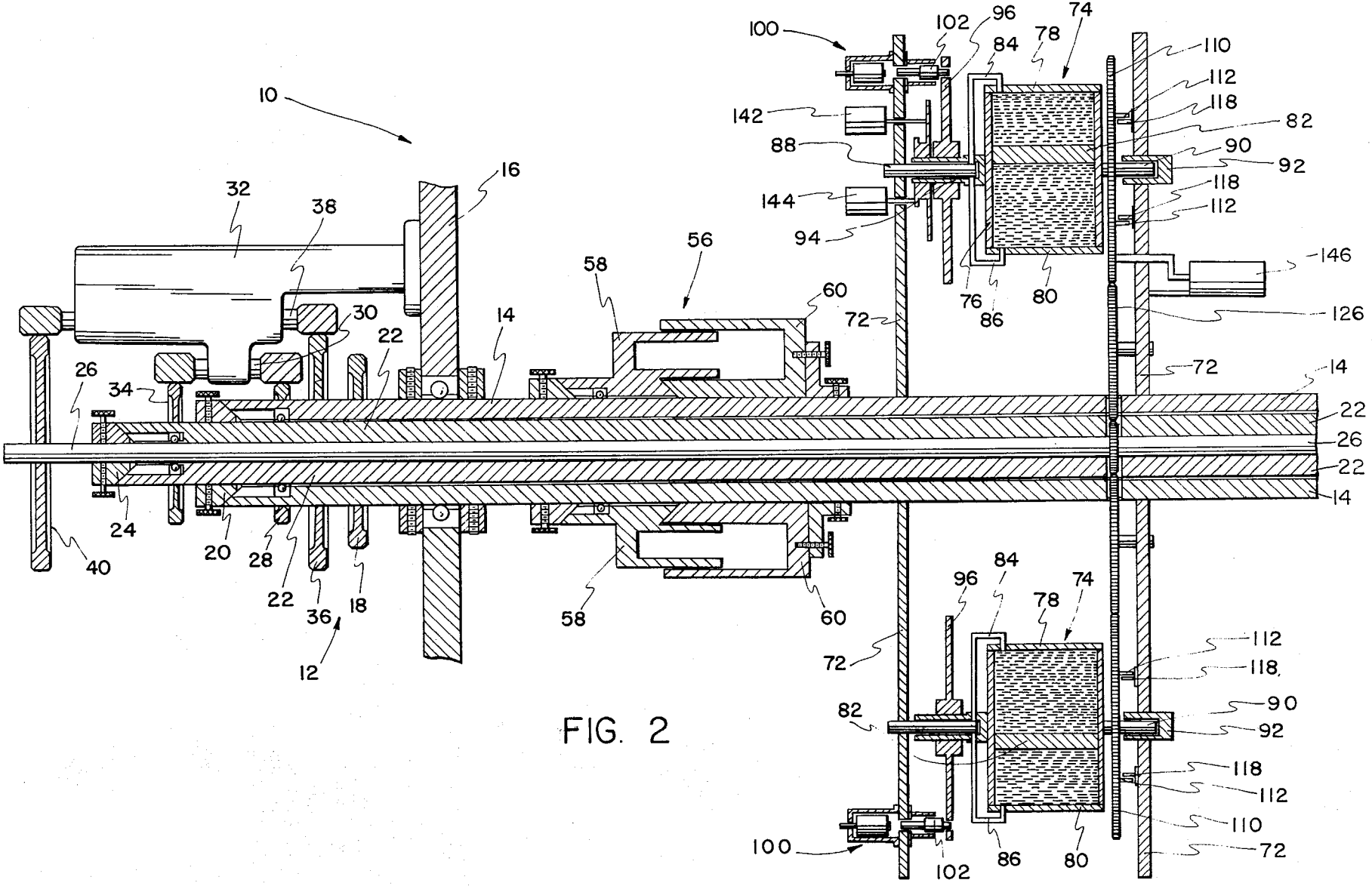
FIG. 2 is a partial longitudinal sectional view of the centrifugal pump and drive assembly of the present invention, this view illustrating what is referred to as generally the left side of the centrifugal pump and drive assembly.
Figure 3:
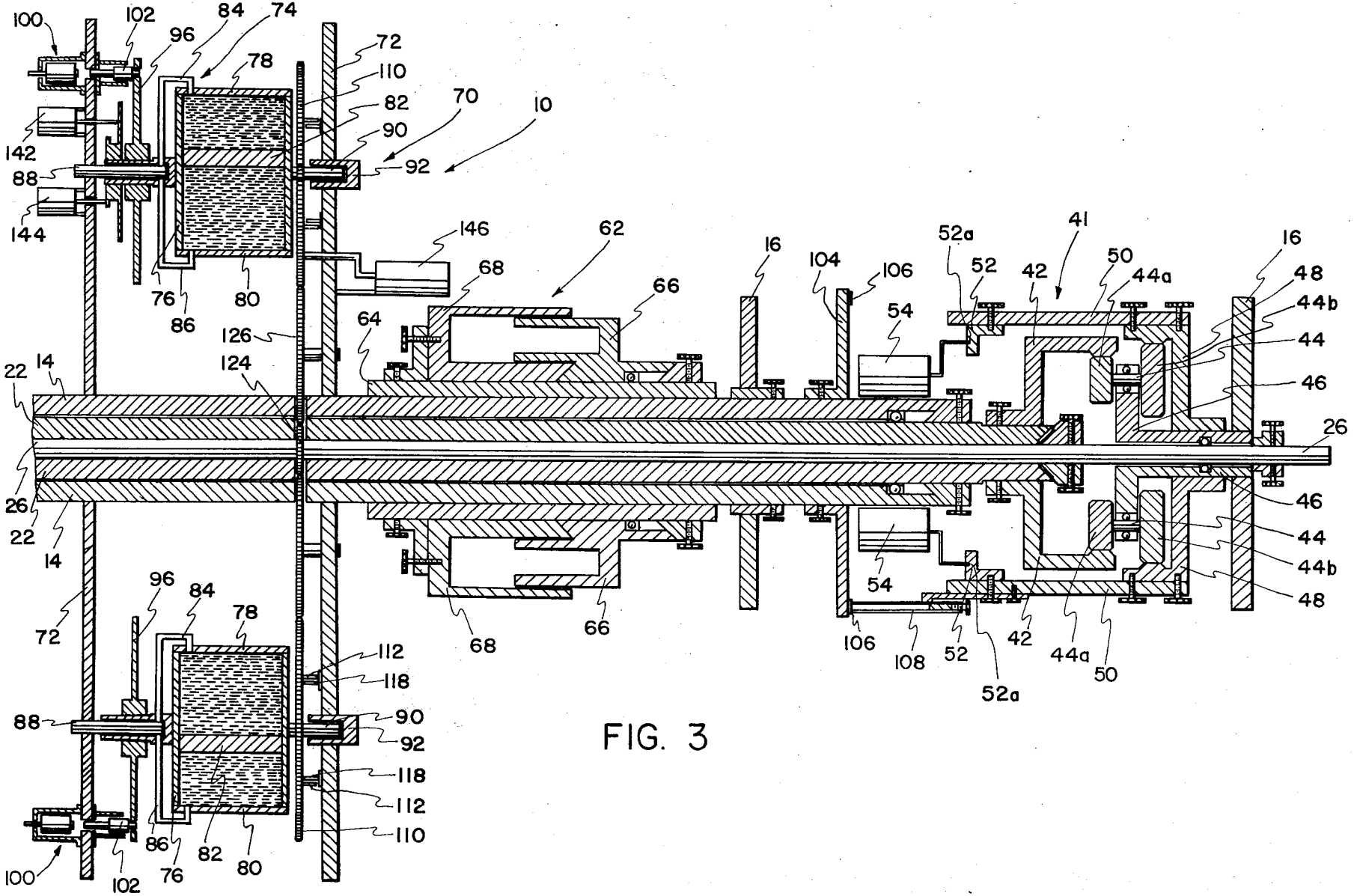
FIG. 3 is another partial longitudinal sectional view of the centrifugal pump and drive assembly, this view generally being a continuation of FIG. 2 and generally referred to as the right side of the centrifugal pump and drive assembly (It will be appreciated that any desired number of pumping stages may be provided between each pumping stage shown in FIGS. 2 and 3).

With further reference to the drawings, particularly FIGS. 2 and 3, the centrifugal pump or rotary power generating mechanism of the present invention is shown therein and indicated generally by the numeral 10. Viewing the rotary power generating mechanism 10, it is seen that the same basically comprises a rotary assembly 12 including an elongated cylindrical outer hub 14 supported by a plurality of axially spaced hub support members 16, the outer hub 14 being rotatively journaled within each of said hub support members 16. Fixed to the outer hub 14 and rotatable therewith is a drive gear 18 that is operatively driven via a meshing gear by a conventional power source such as an internal combustion engine (not shown) or the like. Disposed on each end of the cylindrical outer hub 14 is an end cap 20.

Rotatively journaled interiorly of the outer hub 14 is an inner cylindrical hub 22 that extends a predetermined distance outwardly from each end of the outer hub 14, as best illustrated in FIG. 2. Also, it should be pointed out that the inner hub 22 includes an end cap 24 secured on the outer ends thereof. Rotatively journaled interiorly of the inner hub 22 is a cam shaft 26, the cam shaft being co-axially aligned with both hubs 14 and 22 and extending outwardly beyond the respective ends of the inner hub 22. It should be appreciated that the outer hub 14, the inner hub 22, and the cam shaft 26 are all rotatively journaled with respect to the other such that any one may be driven independently of the others.

From a complete reading of the present disclosure and an understanding of the present invention, it will be seen that the rotary assembly 12 of the present invention is designed to generate three distinct relative spin movements that are used to perform various mechanical functions. The first relative spin movement is achieved between the outer hub 14 and the inner hub 22. This is accomplished by the provision of a drive gear 28 fixed to and rotatable with the outer hub 14 and meshed with a double transfer gear 30 that is rotatively journaled in a gear housing 32 that is supported by the hub support 16 disposed on the left-side of the rotary assembly 12 as viewed in FIG. 2. Double transfer gear 30 is operative to mesh with driven gear 34 that is in turn fixed to the extended portion of the inner hub 22. Therefore, it is appreciated that the torque generated by the outer hub 14 as it is driven by gear 18 is transferred to the inner hub 22. By selecting certain size gears, a desired relative spin movement between outer hub 14 and inner hub 22 can be realized.

A second relative spin movement is accomplished by the provision of a second drive gear 36 also fixed to the outer hub 14 and meshed with a second double transfer gear 38 also rotatively journaled within housing 32. As the second double gear 38 is rotatively driven, the driving torque associated therewith is transferred to a driven gear 40 that is fixed to the outer extending end of the cam shaft 26 and accordingly drives the same as the outer hub is driven, as illustrated in FIG. 2. Therefore, it is appreciated once again that by selecting the particular size of gears to be used, that a particular relative spin movement can be realized between the outer hub 14 and the cam shaft 26.

Turning now to the other end of the rotary assembly 12 and to the third relative spin movement, it is seen that a rotary collar sub-assembly is provided on that end of the rotary assembly and indicated generally by the numeral 41. Viewing the rotary collar sub-assembly 41 in detail, it is noted that the same comprises an internal gear 42 fixed to the extended portion of the inner hub 22 and rotatable therewith. Meshed with the internal gear 42 is a double gear 44, the double gear including a small gear 44*a* directly meshed with the internal gear 42 and a larger gear 44*b* that is meshed with an internal carrier gear 48. Carrier gear 48 is in turn rotatively journaled around a gear holder 46 which is bearinged around cam shaft 26 and includes openings formed in a flange area thereof for receiving and rotatively journaling the double gear 44.

Fixed to the carrier gear 48 about the exterior thereof is an inwardly extending support 50 which has a cam plate 52 fixed thereto and extending around the rotary assembly 12. The cam plate 52 has a circular groove 52*a* formed therein and particularly shaped to actuate a hydraulic valve 54 which as will become apparent from subsequent portions of the present disclosure is adapted to apply a breaking force to individual hydraulic cylinders utilized within the various pumping stages of the present device. Consequently, it is appreciated that there is distinct relative spin movement between the cam plate 52 and the outer hub 14 of the rotary assembly, and that the particular relative spin relationship between the two is determined by the specific arrangement and gear size just discussed.

Disposed inwardly of the left side of the rotary assembly as viewed in FIG. 2, is provided a pressure tank indicated generally by the numeral 56. The pressure tank 56 is of a double-half section type of construction and as such includes an inner-half section 60 fixed to the outer cylindrical surface of the outer hub 14 and rotatable therewith. Extending interiorly of the inner-half section 60 is an outer-half section 58, the outer-half section being bearinged around the outer hub 14 closely adjacent the inner-half section 60. It is intended that the outer-half section 58 remains generally stationary with respect to the outer hub 14 as the inner-half section 60 rotates therewith. Between the sliding surfaces of the outer and inner-half sections 58 and 60, there is provided appropriate fluid seals and appropriate bearings to allow for movement of one-half section while the other half section remains stationary. As particularly illustrated in the drawings, it is seen that the two half sections 58 and 60 join together to form an internal fluid tank therebetween.

Disposed inwardly of the right side of the rotary assembly 12 is a supply tank indicated generally by the numeral 62. The supply tank 62 is of the same basic type of construction as the pressure tank 56 just described, with the exception that the supply tank is disposed outwardly of a transit collar 64 innerposed between the tank and the outer hub 14. Transit collar 64 includes openings that extend generally parallel with the axis of the rotary assembly 12 that allows various lines, wires, etc., to be extended adjacent the rotary assembly 12 underneath the supply tank 62. Although details of the supply tank will not be undertaken herein because of its basic similarity to the pressure tank 56 just discussed, it should be pointed out that the same includes outer and inner-half sections 66 and 68, respectively.

Between the pressure tank 56 and the supply tank 62, there is disposed a plurality of what is referred to as pumping stages, each pumping stage being indicated generally by the numeral 70 and housed between two spaced apart rotary plates 72 fixed to the outer hub 14 and rotatable therewith as the hub is driven. The embodiment illustrated herein includes four pumping stages, but it will be appreciated that any number of pumping stages greater than two could be utilized for the power generating mechanism or centrifugal pump 10 of the present invention. In each pumping stage, there is provided at least two circumferentially spaced hydraulic cylinder assemblies 74, the cylinder assemblies being equally spaced about a circular path within the two rotary plates 72 for the purpose of balancing each stage. It should be pointed out that each stage could be spin balanced by the use of counter weights, etc. Also, it should be pointed out that the hydraulic cylinder assemblies 74 of each stage are innerconnected such that the fluid output of one hydraulic cylinder assembly may serve as the input to an adjacently connected hydraulic cylinder. In addition, respective hydraulic cylinder assemblies of each stage are operatively innerconnected such that it is possible for fluid to be pumped through each hydraulic cylinder within the total system of the pumping stages, except those hydraulic cylinders that may be undergoing the recharging process as will be understood from subsequent portions of the disclosure.

Figure 4:
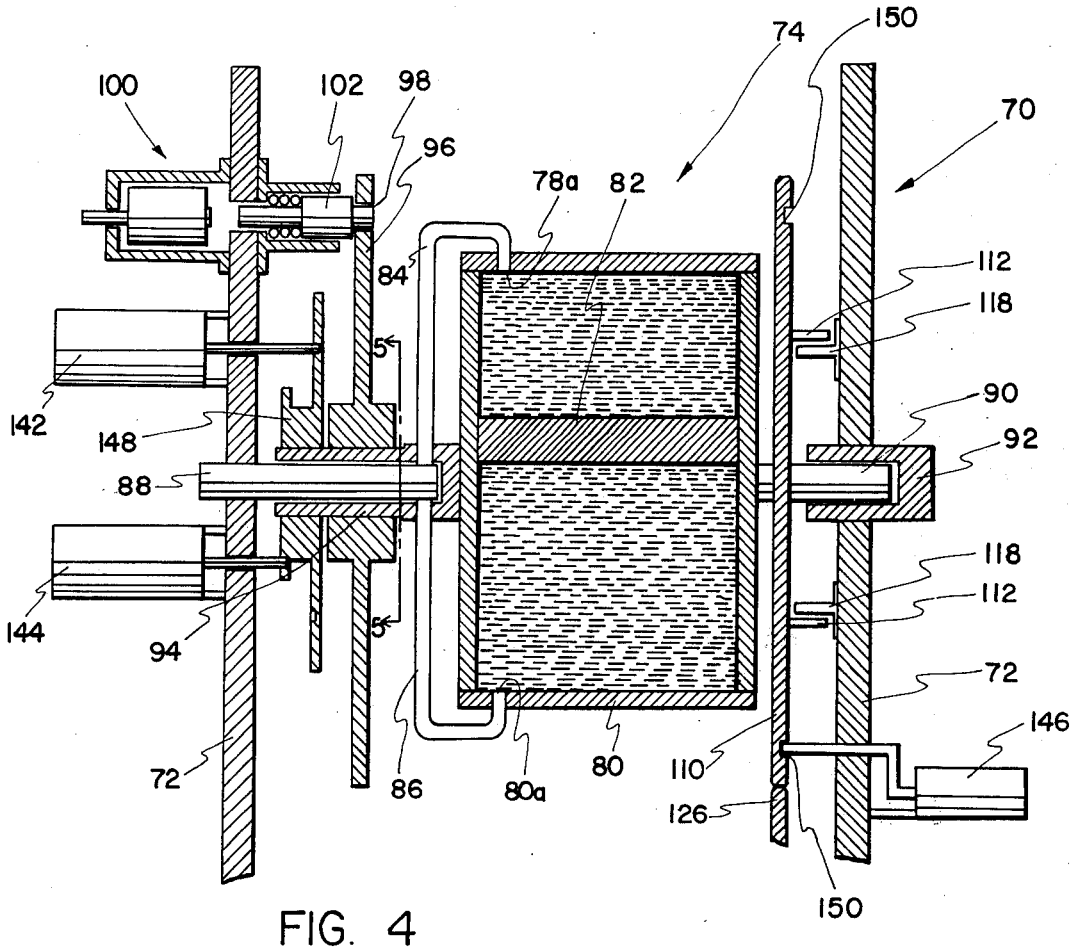
FIG. 4 is a fragmentary sectional view of a portion of a respective pumping stage, particularly illustrating in section the structure of a hydraulic fluid cylinder assembly.
Figure 5:
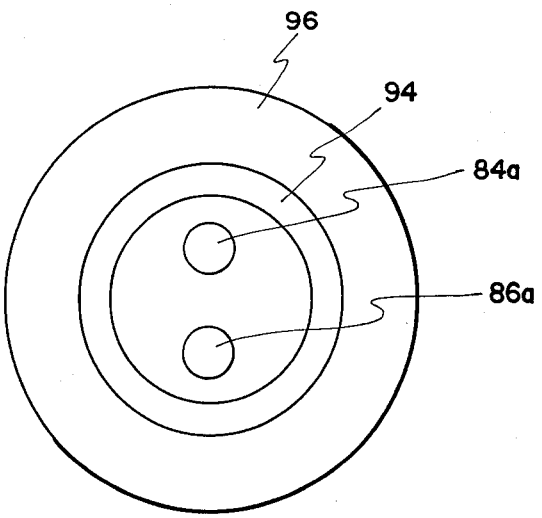
FIG. 5 is a view taken generally along the line 5—5 of FIG. 4.

Because all of the hydraulic cylinders 74 are essentially the same, the following discussion will deal with only one, and it will be understood that the structure and operation of the one will be essentially the same for all others. Thus, viewing the structure of a particular hydraulic cylinder assembly 74, it is noted that the same, as best illustrated in FIG. 4, comprises a hydraulic fluid cylinder 76 having opposite ends 78 and 80, each end having a port formed therein, 78*a* or 80*a*, to allow fluid to flow therefrom. Slidably mounted within the hydraulic cylinder 76 is a piston 82, the piston being movable between the ends 78 and 80 and generally along the longitudinal axis of the hydraulic cylinder structure 76. Extending from the ports 78*a* and 80*a* formed in the ends of the hydraulic cylinder 76 is a pair of outlet tubes 84 and 86 that connect to respective lateral openings 84*a* and 86*a* extending through the stub axle 88. The function and utility of these outlet tubes will be discussed in somewhat greater detail in subsequent portions of the disclosure and consequently at that time a better understanding of the purpose of such will be appreciated.

Each hydraulic cylinder 76 is suspended between respective rotary plates 72 and in normal operation, the hydraulic cylinders 76 are radially aligned with the rotary assembly 12. By being radially aligned, it is meant that the piston 82 of the hydraulic cylinders 76 move along a radial line with respect to the longitudinal axis of the rotary assembly 12 or the cam shaft 26. To properly suspend the hydraulic cylinder 76 between the rotary plates 72, there is provided a stub axle 88 that is fixed within the rotary plate 72 and extends inwardly therefrom. Also, a stub axle 90 is fixed to the opposite side of the hydraulic cylinder 76 and extends outwardly therefrom where the same is rotatively journaled in an axial housing 92. The other side of the hydraulic cylinder 76 is provided with a rotatable collar 94 that is journaled about the stub axle 88. Consequently, hydraulic cylinder 76 is rotatively supported about the longitudinal axis extending through the stub axles 88 and 90.

Disposed between the hydraulic cylinder 76 and a respective rotary plate 72 is a stop disc 96 which is fixed to the rotatable collar 94 and rotatable therewith. Stop disc 96 includes two 180° spaced apart openings 98 formed therein for receiving the locking pin 102 associated with a solenoid actuated stopping mechanism 100 that is mounted to a respective rotary plate 72 at a predetermined location that properly aligns the stopping pin 102 with the radial position of openings 98.

The solenoid actuated stopping mechanism 100 is normally closed, i.e., the locking pin 102 is extended into a respective opening 98. In the recharging of each individual hydraulic cylinder 76 it becomes necessary to rotate the hydraulic cylinder 180° with respect to the rotary plates 72. Also, it is important to hold the hydraulic cylinder in radial alignment with the rotary assembly 12 during the pumping operation, and this is precisely the function of the engagement of the locking pin 102 with the opening 98 within the stop disc 96. So, therefore, in the recharging process, at the time a particular hydraulic cylinder 76 is to be rotated and recharged, it is seen and appreciated that it becomes necessary to withdraw the locking pin 102 from the opening 98. To achieve this function, there is provided on the right-hand side of the rotary assembly 12, as best viewed in FIG. 3, a disc 104 fixed to the outer hub 14 and rotatable therewith. Disc 104 includes a plurality of particularly spaced conductors 106 that engage the inward end of a solenoid actuating assembly 108 fixed to the extension support 50. The solenoid actuating assembly 108 is electrically connected to the solenoid switching mechanisms 100 so as to unlock the locking pin 102 from the stop disc in time relationship to a predetermined recharging cycle or sequence. In other words, at the appropriate time the hydraulic cylinders 76 is to be recharged, the solenoid actuating assembly 108 is actuated by the disc 104 to send a current to solenoid mechanism 100 which in turn withdraws the locking pin 102 for an instant of time in order that the hydraulic cylinders 76 and the stop disc 96 may rotate 180° for purposes of recharging. After the hydraulic cylinders 76 and associated stop disc 96 have begun to rotate, the solenoid switching mechanism 100 is deactivated and the pin 102 is spring biased to its outer position at which time it engages the stop disc 96 during rotation. As the next preceding opening 98 registers with the position assumed by the stopping pin 102, it follows that the spring will bias the locking pin into the opening 98 and the hydraulic cylinder will be locked into its correct radial aligned position.

To provide the mechanical force for rotating each hydraulic cylinder 76, there is provided a gear wheel 110 fixed to the stub axle 90 and rotatable therewith. The gear wheel 110 includes a circular break drum 112 and there is provided adjacent thereto a breaking mechanism 118 that is of a conventional breaking design and which is operated through the fluid valve 54 controlled by the groove 52*a* formed in the plate 52, as seen in FIG. 3. This valve is preferably mechanically actuated and is fixed on outer hub 14 such that the valve can be actuated by a mechanical linkage or arm operatively connected between groove 52*a* and the valve itself. There would be a separate valve 54 for each pump stage.

Figure 6:
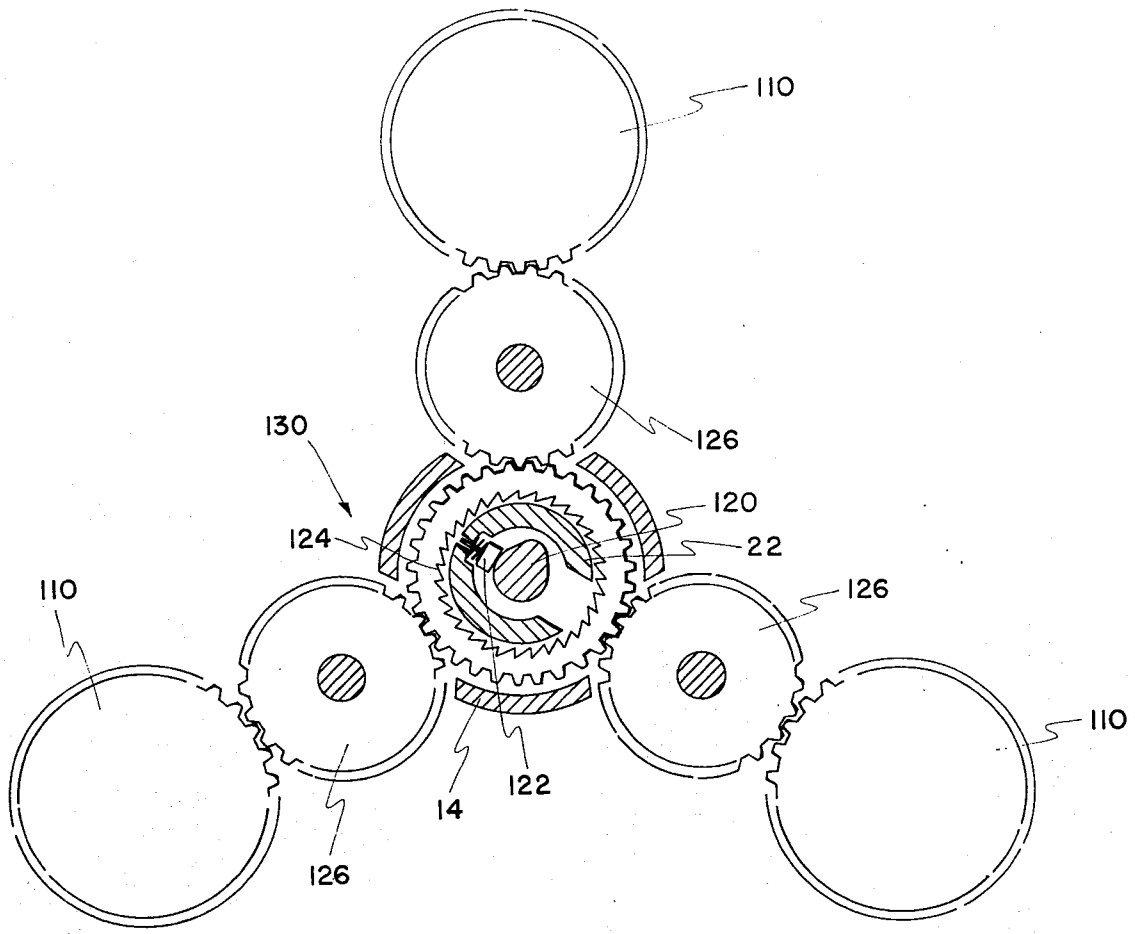
FIG. 6 is a generally schematic view illustrating the cylinder rotating drive assembly utilized by each of the pumping stages for recharging.

In order to rotate each hydraulic cylinder 76 during the recharging process, there is provided a mechanical gear system for rotating and recharging all of the hydraulic cylinders in one stage simultaneously, this mechanical gear system is indicated generally by the numeral 130 and particularly shown in FIG. 6.

For each pumping stage, there is provided a certain mechanical gear system. Each gear system comprises a cam 120 formed on the cam shaft 26 at a position generally aligned with the radial position of the particular pumping stage involved. Cam 120 engages a cam follower 122 that is spring biased against the cam shaft and generally disposed in an opening formed within the inner hub 22. When cam 120 engages cam follower 122 the outer end of the cam follower is adapted to move radially pass the outer circumference of the inner hub 22 and to engage the internal teeth of a central gear 124 rotatively mounted between the outer hub 14 and inner hub 22 at particular axial spaced locations along the rotary assembly 12. The central gear 124 includes outer teeth that mesh with any number of satellite intermediate gear 126 that extend through window openings in the outer hub 14. The intermediate gears 126 are rotatively supported by respective rotor plates 72 and also mesh with the gear wheel 110 that in turn rotates the respective hydraulic cylinders 76. As the cam shaft turns, there is relative spin movement between the cam shaft 26 and the outer hub 14 and inner hub 22. Consequently, this relative spin movement can be predetermined to be a value that is necessary to actuate the mechanical gear system 130 at proper time intervals to effectuate recharging for that particular pumping stage. Generally, the rotation of the cam shaft 26 will be slightly greater or less than the rotation of the outer and inner hubs 14 and 22, respectively, such that periodically the cam follower 122 will be actuated by the cam 120 and caused to engage the central gear 124. Engagement of the central gear 124 with the cam follower 122 causes the central gear to be rotated in unison with the inner hub 22 which because of the relative spin movement between the inner hub 22 and the outer hub 14 will cause the intermediate gears 126 to be actuated and turned, which in turn rotates the gear wheel 110 and effectuates recharging by rotating the hydraulic cylinders 76 approximately 180°. The shape of the cam and the rotation speed of the cam shaft 26 can be designed especially to limit the rotation of the hydraulic cylinders to precisely 180°. It will be understood and appreciated that each of the gear systems 130 just described will be axially spaced along the rotary assembly 12 and for each of the pumping stages 70 there will be provided a gear system 130 for purposes of recharging each individual hydraulic cylinder 76.

As the rotary assembly 12 is rotatively driven, each of the hydraulic cylinders 76 will at some time in the pumping operation include a volume of fluid therein. At the beginning of each pumping cycle for each hydraulic cylinder 76, the piston 82 will be spaced inwardly adjacent the inward end and as the rotary assembly 12 is rotatively driven, the piston 82 will be forced outwardly under the influence of centrifugal force.

As the piston 82 is pushed outwardly by the influence of centrifugal force, the fluid disposed outwardly thereof is expelled from the outer end of the hydraulic cylinder 76 under pressure. Because the various hydraulic cylinders 76 of the total pumping system are connected in a series network, the output of anyone hydraulic cylinder may be the input of another such hydraulic cylinder. In this way, the pressure of the fluid expel lead from respective hydraulic cylinders as the fluid is pumped through the entire system is compounded, thereby increasing the potential energy associated with this fluid. Finally as the fluid moves from the supply tank 62, through the respective hydraulic cylinders 76 of the pumping system, and into and through the pressure tank 56, the pressure of the fluid is continually built-up and has substantial energy associated therewith that can be utilized by a conventional hydraulic motor or some other conventional energy generating system that is adapted to be driven by fluid flow.

It is appreciated that during the pumping operation that the hydraulic cylinders 76 in any respective stage will have to be recharged by rotating the hydraulic cylinders 76 by 180° with respect to the rotors 72. By rotating said hydraulic cylinders, the net effect is to reverse the position of the fluid within the cylinder in relationship to the piston 82. In other words, it is proper to recharge the hydraulic cylinders 76 when the piston has moved outwardly adjacent the outer end of the hydraulic cylinder and the fluid previously within the hydraulic cylinder has been expelled while fresh fluid has been received in the hydraulic cylinder as the piston moved outwardly. Consequently, by rotating the cylinder 180° the piston then assumes a position adjacent the innermost end of the hydraulic cylinder and fluid is disposed on the outer side thereof. So, therefore, once recharging is accomplished by rotation, the piston is on a position to be influenced by centrifugal force and to be driven against the outwardly disposed fluid so as to expel the same from the hydraulic cylinder under pressure.

FLOW THROUGH PUMPING STAGES AND THE RECHARGING PROCESS

Figure 7:
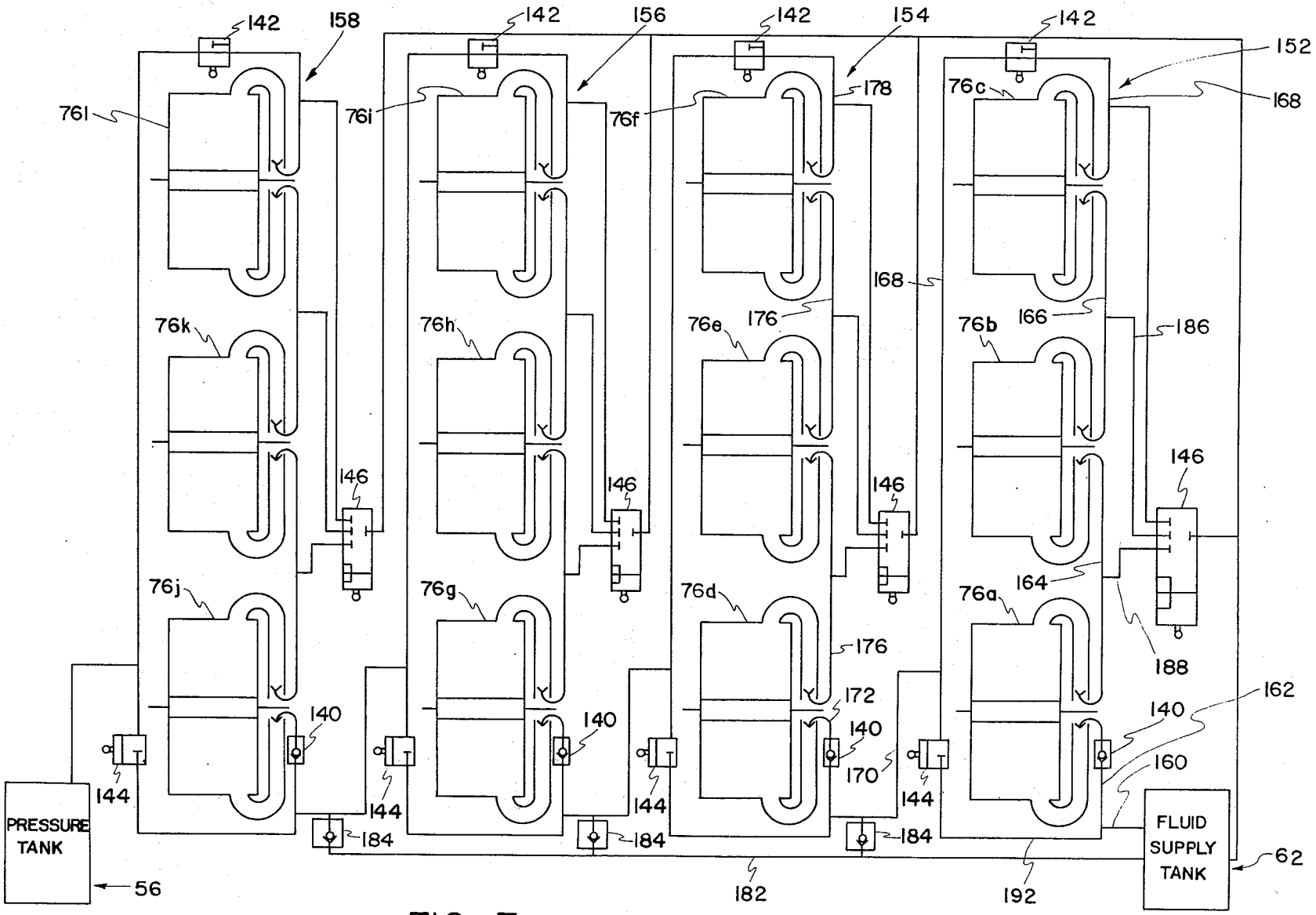
FIG. 7 is a schematic fluid flow diagram illustrating the fluid flow in pumping system having four stages, three cylinders per stage.

With reference to the schematic drawing illustrated in FIG. 7, there is shown a plurality (four) of operatively connected pumping stages 152, 154, 156 and 158. Each stage as represented in the schematic drawings consist of three hydraulic cylinders, such as hydraulic cylinder 76 described above. It, however, should be understood that each pumping stage could include various numbers of hydraulic cylinders as long as the various hydraulic cylinders comprising each stage are generally equally and circumferentially spaced around each pair of respective rotor plates 72 to effectively yield a balance pumping system.

As had already been indicated, it is basic to the present invention that the individual hydraulic cylinders of each stage be operatively connected together such that the fluid output of any one cylinder may be the fluid input of an adjacently connected cylinder. In addition, it is further basic to the present invention that at least one hydraulic cylinder of a particular stage be operatively connected to at least one hydraulic cylinder of another stage. Consequently, by providing such a series connected network of hydraulic cylinders, it is seen that fluid can be pumped through individual stages and that the same fluid pumped through that individual stage can be pumped through another stage and so forth and so on. This effectively compounds the pressure as the fluid moves through the multiplicity of stages comprising the pumping system.

Each pumping stage has operatively associated therewith four fluid control valves. One valve is a one-way check valve indicated by the numeral 140 and is generally connected between the fluid supply tank and the initial hydraulic cylinder of that particular stage. This one-way check valve 140 is not an actuated valve but always allows flow in one direction as indicated by the symbol while rejecting flow in the other direction. Also, as illustrated in FIG. 7, each stage includes two simple two positional valves 142 and 144 that are actuated by a valve actuating disc 148 fixed to the rotatable collar 94 of only one of the hydraulic cylinder assemblies 74 of each stage. Valve actuation disc 148 includes one or two grooves for actuation valves 142 and 144 according to a predetermined actuating sequence that will be discussed subsequently herein. The final valve associated with each stage is a two position multi-line inlet valve 146, that as illustrated in FIG. 7 includes three inlet lines and one outlet line. This allows flow from three different lines into the valve while the vale is open and flow therefrom can integrate from all three inlet lines and leave the one line extending from the valve or flow can enter the valve from any one of the inlet lines and leave through any other of the inlet lines. These various valves may be fixed to a respective rotor 72 and rotatable therewith as the pump 10 is driven.

For purposes of explanation, assume that during the pumping operation all stages 152, 154, 156 and 158 could be and are performing a direct pumping function and neither stage is being recharged. In such a situation, as the rotor assembly 12 is rotatively driven the respective pistons of each stage are being urged outwardly under the influence of centrifugal force (for the sake of explanation, assume that in FIG. 7, outward movement corresponds to movement of the pistons from the lower end to the upper end of the cylinder). Fluid from the fluid supply tank 62 is sucked through line 160 into line 162, through the one way check valve 140 into the L-compartment of hydraulic cylinder 76*a*. Fluid within compartment M of hydraulic cylinder 76*a* is expelled therefrom through line 164 into compartment N of hydraulic cylinder 76*b*. The fluid in compartment O of hydraulic cylinder 76*b* is expelled therefrom, again due to the centrifugal force of the rotary assembly 12 and out line 166 into compartment P of hydraulic cylinders 76*c*. Fluid in compartment Q of hydraulic cylinders 76*c* is expelled therefrom through line 168 through the normal open (i.e., flow may move through) valve 142 and on through line 168 where the fluid thereof enters line 170 because valve 144 is normally closed. From line 170, the fluid is transmitted through one way valve 140 (of stage 154) into compartment R of hydraulic cylinders 76*d* disposed within the second stage 154. Fluid is pumped from hydraulic cylinders 76*d* into hydraulic cylinders 76*e*, and so on through the second stage 154 into the third and fourth stages 156 and 158 just as described for stages 152 and 154. Therefore, it is appreciated that in the normal pumping mode, valves 144 and 146 of each stage are normally closed, while valve 142 is normally open and the one-way check valve 140 is, of course, open in the one direction indicated by the valve symbol.

It is appreciated that at any time during the pumping operation that it is important for one of the stages, either 152, 154, 156 or 158, to be experiencing the recharging process which as explained hereinbefore entails the rotation of each hydraulic cylinder 180° so as to reorient the radial position of the pistons. The valve actuating disc 148 and the groove 150 in gear wheel 110 is adapted to actuate valves 142, 144 and 146 during the recharging process.

For the purpose of controlling recharging, there are three phases of control during the recharging of the hydraulic cylinders associated with any one stage. The first phase of control exists as the hydraulic cylinders of the stage are rotated from their normal radial aligned position through an angle of 45° or any other desired or selected angle increment of tilt. During this first phase, the valve control system functions to open the two-position valve 144 while maintaining valve 146 closed and valve 142 open. If we assume that stage 152, as schematically illustrated in FIG. 7, is being recharged, it is seen that a loop flow of fluid around stage 152 is obtained, i.e., fluid will generally flow around the particular hydraulic cylinders 76*a*, 76*b* and 76*c* of that stage. In particular, fluid could flow from compartment M of 76*a* through line 164 into compartment N of 76*b*, from compartment O of 76*b* through line 166 into compartment P of cylinder 76*c*, and from compartment Q of the same hydraulic cylinder 76*c* through line 168 through open valve 142, back to line 168, through open valve 144, and through the one-way check valve 140 into compartment L of hydraulic cylinders 76*a*, thereby completing the fluid loop around stage 152.

It is also seen that in this part of the recharging process as far as stage 152 is concerned, that fluid from the supply tank 62 can enter compartment R of cylinders 76*d* of stage 154 through a main inlet line 182, through one-way check valve 184 and through the one-way check valve 140 of stage 154. Consequently, the fluid can completely by-pass the recharging stage 152 and be received by stage 154 where the fluid can be properly pumped therethrough and on through the succeeding stages 156 and 158 as described above while the first stage or stage 152 is experiencing the recharging process. It should be pointed out that during this first phase of recharging, i.e., through the first 45° (or less), that the individual pistons associated with the hydraulic cylinders 76 could possibly continue some pumping function if they have not reached the outer disposed end of the hydraulic cylinder at the time recharging is initiated since fluid could flow from line 168 into line 170, and on into cylinders 76*d* of stage 154. It is also this first phase of the recharging process that allows the individual piston to finally move towards the outermost end of the hydraulic cylinders of that stage.

During the second phase of recharging stage 152, i.e., from the 45° to 90° rotation of the hydraulic cylinders, valve 144 remains open while valve 142 is closed, and valve 146 is open. From a close study of FIG. 7, this allows for fluid flow in individual loops around respective hydraulic cylinders of the stage being recharged. For example, in the case of hydraulic cylinders 76*b*, any fluid in compartment O may be expelled through line 166 into line 186, through valve 146 and back through line 188 and into compartment N of the same hydraulic cylinder 76*b* via line 164. Consequently then, it is seen that a closed fluid loop exists around cylinders 76*b* and by close examination with the valves 142, 144 and 146 in this particular mode of operation during this second phase of control, it will be seen that likewise hydraulic cylinders 76*a* and 76*c* also have a closed loop therearound that allows fluid to flow from one compartment thereof to another.

The third and final phase of the recharging process of stage 152 occurs as each hydraulic cylinder is rotated from 90 degrees to the 180° position. In this mode, valve 144 remains open and valve 142 remains closed, and valve 146 is actuated to a closed position. The effect of this is that fluid flow is essentially blocked from the recharging stage, or stage 152. It is seen that fluid cannot flow from the stage because valve 142 is closed in the one direction and fluid cannot flow through closed valve 146. Also, fluid cannot flow in the direction opposite the transmitting direction of the one-way check valve 140. But still it is seen that fluid from the fluid supply tank can easily by-pass the recharging stage 152 as fluid may enter compartment R of hydraulic cylinders 76*d* of stage 154 in either of two ways. First, fluid may move from the fluid supply tank into line 182 and through one-way check valve 184, through one-way check valve 140 of stage 154 into compartment R of hydraulic cylinders 76*d*. On the other hand, fluid may move through the line 160, through line 192, through open valve 144 into line 170 and from there into compartment R of hydraulic cylinders 76*d*. So, therefore, this completes the general description of the valve control for recharging a particular stage of the pumping system of the pump or power generating system 10 of the present invention. It will be appreciated that in operation the various stages are timed such that the stages recharge sequentially, that is one stage recharges right after another and that a stage is recharging at all times. The effect of this is that the system comprising the operatively interconnected network of hydraulic cylinders continuously pump fluids therethrough and has the capacity to even receive fluid from a recharging stage or to completely by-pass the same during the recharging process.

FLOW CONTROL SYSTEM

As the rotor assembly 12 is rotatively driven and fluid is pumped from the fluid supply tank, through the various stages of the pump and on through the pressure tank, it is quite important to maintain a constant relative flow in order that the pump operate as efficiently as possible (constant relative flow meaning in relationship to the operating characteristic of the pump at any time). In order to provide flow control and particularly to provide for a constant fluid rate output from the various pumping stages of the system, the present invention envisions the utilization of some form of flow control to be operatively connected between the pump 10 and the fluid power drive mechanism being driven by the pump such as a hydraulic motor or the like.

Figure 8:
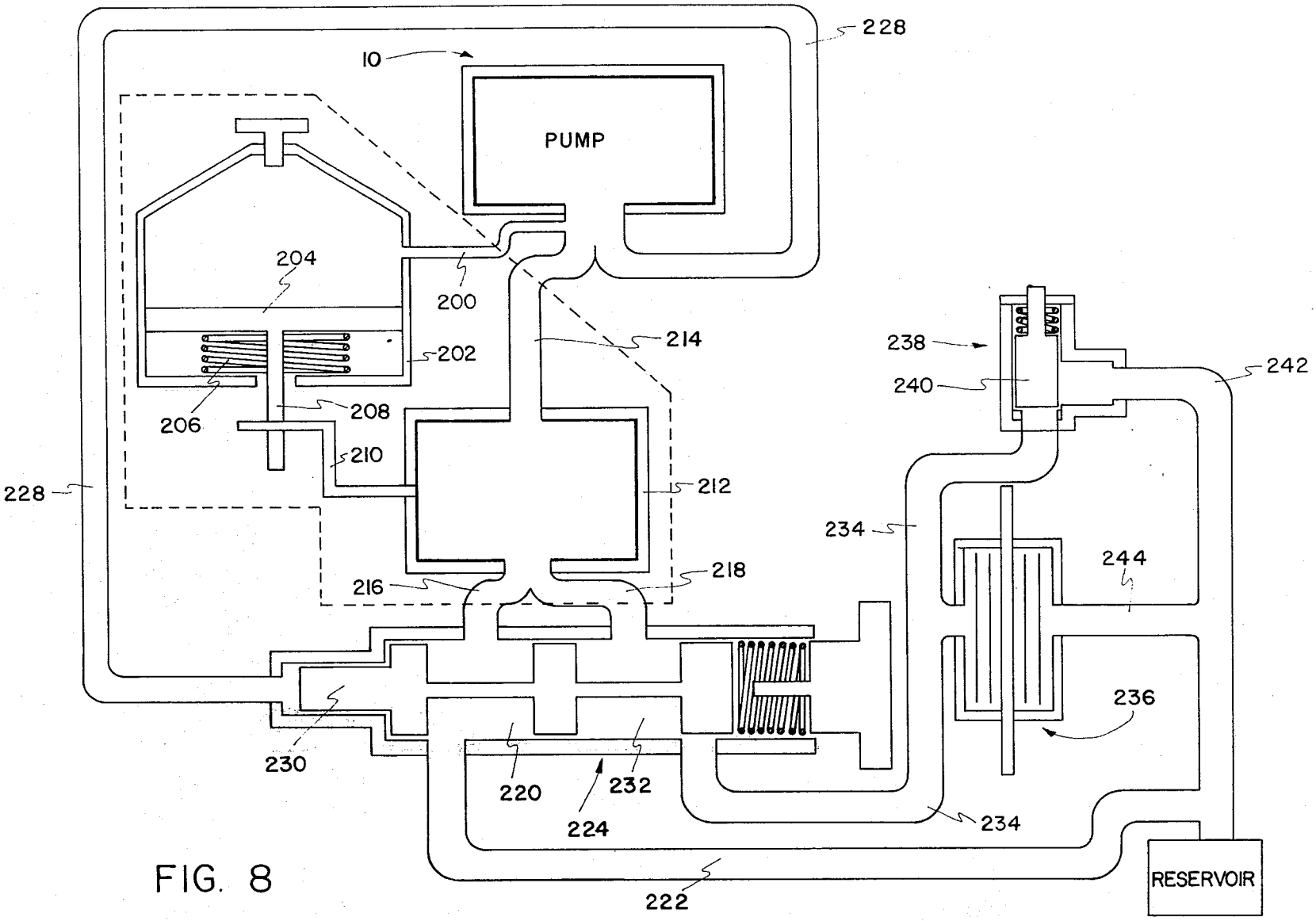

In this regard and with reference to FIG. 8, there is provided a type of flow control system that would generally control the fluid flow from the pump 10 and would maintain a constant relative flow therefrom. Viewing this flow control system in detail, it is seen that from the pump 10 there extends a line 200 that leads into a chamber of a pressure responsive control cylinder 202 that includes a piston 204 reciprocally mounted therein. Disposed between the piston 204 and the lower end of the cylinder 202 is a coil spring 206 that biases the piston towards the upper portion of the cylinder 202. Fixed to the piston 204 and extending therefrom through the lower portion of the cylinder is an extension member 208 that is operatively connected to a linkage mechanism 210 which is in turn operative to actuate a variable opening flow fluid control valve 212. Extending between the inlet side of the variable flow valve 212 and the pump 10 is line 214. Therefore, it is appreciated that cylinder 202 is pressure responsive to the pressure in line 200 in order to actuate the valve 212 in order that the fluid passing opening therein varies according to pressure so as to enable a constant flow to flow between the pump 10 and through the variable flow control valve 212.

Extending from the outlet side of the valve 212 is a pair of lines 216 and 218, line 216 being connected to a normally open chamber 220 formed in a main control valve indicated generally by the numeral 224. So, therefore, normally in this position, as illustrated in FIG. 8, the flow of fluid is through line 216, through chamber 220 and on through line 222 which leads to the fluid supply reservoir.

As the fluid pressure of the fluid leaving the pump 10 increases, this fluid pressure is transmitted through line 228 to actuate spool 230 within the main control valve 224, causing the valve spool 230 to be shifted towards the right, as viewed in FIG. 8, so as to close the opening between line 216 and the chamber 220 of valve 224. The shifting of the valve opens line 234 of the valve to chamber 232 and allows for flow of fluid from the variable control valve 212 through the main control valve 224, through line 234 into inlet side of the hydraulic motor 236 (or other type of fluid drive motor) and on therethrough through line 244 and back to the fluid supply reservoir. It is seen that this causes the drive shaft of the hydraulic motor 236 to be rotated and accordingly, it is seen that the fluid being pumped by the centrifugal pump 10 is now being utilized to drive the fluid motor 236.

As is well appreciated, at the start-up of the hydraulic motor 236, the flow therethrough will be relatively slow and accordingly, to maintain a constant rate of fluid flow, there must be provided some means to by-pass the hydraulic drive motor 236 during initial operation. This is accomplished by the provision of the double actuating valve indicated generally by the numeral 238 and schematically illustrated in FIG. 8. So, therefore, during the initial operation of the hydraulic drive motor 236, the pressure in line 234 will be great enough to open spool 240 and allow fluid flow from line 234 into line 242. As the hydraulic motor 236 begins operation and increases in speed, and fluid flow means therethrough, the fluid pressure in line 234 will decrease and as the pressure decreases spool 240 will in the process move toward its closed position, thereby decreasing the flow of fluid by-passing the hydraulic motor 236. As the hydraulic motor 236 gains speed and has the ability to accommodate the flow in line 234, it is seen that the pressure therein will decrease to a point where spool 240 is completely closed and all the flow in line 234 moves through the hydraulic motor 236. In this closed position, it is thusly appreciated that the relative constant rate fluid flow flowing through valve 212 will pass through main valve 224 into line 234 and on through the hydraulic drive motor 236 supplying energy and driving force to the same in the process. Consequently, it is seen that the fluid flow control system just described provides a continuous and constant rate flow from the pump 10 and consequently allows the same to operate at a very optimum efficiency level.

From the foregoing specification, it is seen that the centrifugal pump 10 of the present invention is of great utility in view of its capacity to convert simple mechanical energy into a readily usable form of fluid energy wherein by the use of centrifugal force the input energy is greatly amplified during the pumping process. In addition, it should be appreciated that the centrifugal pump 10 of the present invention could be utilized in a simple pumping operation wherein fluid such as water is pumped from one locality to another.

The terms "upper", "lower", "forward", "rearward", etc., have been used herein merely for the convenience of the foregoing specification and in the appended Claims to describe the centrifugal fluid pump and its parts as oriented in the drawings. It is to be understood, however, that these terms are in no way limiting to the invention since the centrifugal fluid pump may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embranced herein.

What is claimed is:

1. A centrifugal rotary powered fluid generating assembly comprising:

a rotary assembly having a longitudinal axis about which the same may rotate;

means for rotatively driving said rotary assembly about said longitudinal axis;

cylinder mounting means secured to said rotary assembly and rotatable therewith;

fluid cylinder means secured to said cylinder mounting means and rotatable therewith as said rotary assembly is driven;

a supply tank including a source of fluid operatively connected to said cylinder means wherein fluid can be supplied to the cylinder means of said rotary assembly;

piston means slidably mounted in said fluid cylinder means;

means for normally maintaining said cylinder and piston means in radial alignment with said rotary assembly wherein in radial alignment said piston means tend to move along a radial axis within said cylinder means relative to the axis of said rotary assembly, such that as said rotary assembly is rotatively driven said piston means under the influence of centrifugal force tends to be forced radially outwardly and away from an inward end portion of said cylinder means to an outer end portion thereof, forcing and expelling fluid under pressure from the outer end portion of said cylinder means while inducing fluid to enter the inward end portion of said cylinder means, whereby the energy associated with the pressurized fluid flow being expelled from the cylinder means can be selectively directed and harnessed and used; and recharging means for recharging said cylinder means after the piston means has completed its power stroke and is disposed in the outer end portions of said cylinder means, said recharging means including means for rotating said cylinder means and the piston means associated therewith approximately 180° relative to said cylinder mounting means to a position where said cylinder and piston means are radially aligned with said rotary assembly and said fluid within said cylinder means is disposed generally outwardly of the position assumed by said piston means.

2. The centrifugal rotary power fluid generating assembly of claim 1 wherein said cylinder mounting means comprises at least two pairs of axially spaced apart rotor plates fixed to said rotary assembly and rotatable therewith; and wherein said fluid cylinder means includes a plurality of circumferentially spaced cylinders rotatively mounted between said pair of rotor plates.

3. The centrifugal rotary powered fluid generating assembly of claim 2 wherein said fluid supply tank is disposed on said rotary assembly generally adjacent at least one pair of said rotor plates; and wherein a pressure tank is also disposed on said rotary assembly and communicatively connected to said fluid cylinder means for receiving fluid under pressure therefrom.

4. The centrifugal rotary powered fluid generating assembly of claim 3 wherein both said fluid supply and pressure tanks are of a double unit construction, one unit being rotatively mounted around said rotary assembly and held generally stationary relative thereto, and a second unit fixed to said rotary assembly and rotatable therewith, said second unit being disposed in a sealed relationship relative to said first unit so as to define a fluid holding chamber therebetween.

5. The centrifugal rotary powered fluid generating assembly of claim 2 wherein said rotary assembly comprises: a cylindrical outer hub driven by said means for rotatably driving said rotary assembly, an inner cylindrical hub rotatively journaled within said outer hub, and an elongated cam shaft rotatively mounted within said inner hub and extending through said rotary assembly in co-axial relationship with both said inner and outer hubs.

6. The centrifugal rotary powered fluid generating assembly of Claim 5 including gear means operatively interconnected between said outer and inner hubs and between said outer hub and said cam shaft extending through said rotary assembly for generating a first relative spin movement between said outer and inner hubs and a second relative spin movement between said outer hub and said cam shaft extending through said rotary assembly.

7. The centrifugal rotary powered fluid generating assembly of claim 6 wherein said rotary assembly includes a rotary collar sub-assembly having a gear assembly operatively connected to said inner hub for generating a third relative spin movement.

8. The centrifugal rotary powered fluid generating assembly of claim 7 wherein there is provided a support structure for supporting said rotary assembly to the outer hub of said rotary assembly being rotatively journaled within said support structure.

9. The centrifugal rotary powered fluid generating assembly of claim 8 wherein there is provided a transit collar fixed to said outer hub along the rotary assembly adjacent said fluid supply tank, said transit collar having openings formed in the outer portions thereof for allowing connecting wires and the like to be channeled therethrough.

10. The centrifugal rotary powered fluid generating assembly of claim 5 wherein each of the plurality of circumferentially spaced cylinders rotatively mounted between respective pairs of said rotary plates have a gear wheel operatively connected thereto; and wherein there is provided a gear system operatively interconnected between said rotary assembly and said gear wheel for rotating said cylinders in a predetermined sequence.

11. The centrifugal rotary powered fluid generating assembly of claim 10 wherein each gear system comprises: a cam fixed to said cam shaft and rotatable therewith; a cam follower disposed generally about the inner hub of said rotary assembly; a central gear radially spaced outwardly from said cam follower and adapted to be engaged by said cam follower when the latter is actuated by said cam; and an intermediate gear operatively meshed with both said central gear and said gear wheel fixed to each respective cylinder, whereby said gear wheel and consequently the respective cylinder is rotated for purposes of recharging in response to said cam engaging said cam follower, resulting in said central gear being rotatively driven by said cam follower.

12. The centrifugal rotary powered fluid generating assembly of claim 11 wherein each hydraulic cylinder is provided with a stop disc, and wherein there is provided locking means for engaging said stop disc and for holding the same stationary such that the individual hydraulic cylinders of any stage will be disposed in radial alignment with respect to the longitudinal axis of said rotary assembly.

13. The centrifugal rotary powered fluid generating assembly of claim 12 wherein said locking means includes a locking pin associated with solenoid switch structure fixed to a respective rotary plate adjacent the stopping disc, said stopping disc including at least two circumferentially spaced openings for receiving said locking pin.

14. The centrifugal rotary powered fluid generating assembly of claim 2 wherein the respective cylinders disposed between respective pairs of rotary plates are operatively connected together such that the fluid output of one cylinder serves as the fluid input for another adjacently connected cylinder, whereby as the fluid is pumped from one cylinder to another the fluid pressure therein is compounded.

* * * * *